US008448629B2

(12) United States Patent
Makino et al.

(10) Patent No.: US 8,448,629 B2
(45) Date of Patent: May 28, 2013

(54) FUEL VAPOR PROCESSING APPARATUS

(75) Inventors: Katsuhiko Makino, Aichi-ken (JP); Junya Kimoto, Obu (JP); Masanobu Shinagawa, Aichi-ken (JP); Masaki Ikeya, Obu (JP)

(73) Assignee: Aisan Kogyo Kabushiki Kaisha, Aichi-Ken (JP)

( * ) Notice: Subject to any disclaimer, the term of this patent is extended or adjusted under 35 U.S.C. 154(b) by 449 days.

(21) Appl. No.: 12/780,999

(22) Filed: May 17, 2010

(65) Prior Publication Data

US 2010/0288241 A1 Nov. 18, 2010

(30) Foreign Application Priority Data

May 18, 2009 (JP) ..... 2009-119840

(51) Int. Cl.
*F02M 33/08* (2006.01)
*F02M 33/02* (2006.01)

(52) U.S. Cl.
USPC ..... 123/519; 123/518

(58) Field of Classification Search
USPC 123/518, 516, 519, 520, 521, 198 D; 137/43, 137/493, 587, 588, 589; 220/746, 749
See application file for complete search history.

(56) References Cited

U.S. PATENT DOCUMENTS

| | | | | |
|---|---|---|---|---|
| 5,881,698 | A * | 3/1999 | Tuckey et al. | 123/497 |
| 6,431,156 | B1 * | 8/2002 | Murakami et al. | 123/520 |
| 2005/0235969 | A1 * | 10/2005 | Suzuki | 123/520 |
| 2006/0086343 | A1 * | 4/2006 | Suzuki | 123/520 |

FOREIGN PATENT DOCUMENTS

| | | |
|---|---|---|
| JP | 04-311661 | 11/1992 |
| JP | 05-312114 | 11/1993 |
| JP | 11-173223 | 6/1999 |
| JP | 2000-073898 | 3/2000 |
| JP | 2000 282966 | 10/2000 |
| JP | 2002 235608 | 8/2002 |
| JP | 2002285919 A * | 10/2002 |
| JP | 2007-176289 | 7/2007 |
| JP | 2009-507716 | 2/2009 |

* cited by examiner

*Primary Examiner* — Mahmoud Gimie
(74) *Attorney, Agent, or Firm* — Ladas & Parry LLP

(57) ABSTRACT

A fuel vapor processing apparatus includes a device that can restrict or prevent flow of gas from a vapor passage into a canister during recovering of fuel vapor from the canister into a fuel tank.

13 Claims, 8 Drawing Sheets

FUEL VAPOR PROCESSING APPARATUS

This application claims priority to Japanese patent application serial number 2009-119840, the contents of which are incorporated herein by reference.

BACKGROUND OF THE INVENTION

1. Field of the Invention

The present invention relates to fuel vapor processing apparatus.

2. Description of the Related Art

A fuel vapor processing apparatus is known that includes a vapor passage for introducing fuel vapor, which is produced within a fuel tank of an automobile, into a canister, an atmospheric-side opening and closing device provided to the canister, a negative pressure generating device for generating a negative pressure, and a recovery passage communicating between the negative pressure generating device and the canister. The negative pressure generating device can operate for recovering fuel vapor stored within the canister into the fuel tank via the recovery passage.

This type of fuel vapor processing apparatus is disclosed, for example, in Japanese Laid-Open Patent Publication No. 2002-235608. As shown in FIG. 8, a fuel vapor processing apparatus 100 disclosed in this publication includes a vapor passage 104 for introducing fuel vapor, which is produced within a fuel tank T, into a canister 103, an atmospheric-side opening and closing valve 105 capable of opening the canister 103 into the atmosphere, a negative pressure generating device 107 disposed within the fuel tank T for generating a negative pressure, and a recovery passage 108 communicating between the negative pressure generating device 107 and the canister 103.

Fuel vapor may be produced within the fuel tank T, for example, during parking of an automobile and may be introduced into the canister 103 via the vapor passage 104. The fuel vapor is then adsorbed by an adsorption material (such as activated carbon) that is disposed within the canister 103. Therefore, it is possible to prevent the fuel vapor produced within the fuel tank from being leaked into the atmosphere.

In addition, the fuel vapor stored within the canister 103 may be drawn into the fuel tank T via the recovery passage 108 when the negative pressure generating device 107 is operated during driving of the automobile. The fuel component of the fuel vapor introduced into the fuel tank T is then recovered into the fuel.

However, according to the fuel vapor processing apparatus of the above publication, the internal pressure within the canister 103 becomes negative during recovering of the fuel vapor, and therefore, gas contained within the fuel tank T may flow from the vapor passage 104 into the canister 103. In other words, the adsorption material disposed within the canister 103 is purged by the gas contained within the fuel tank T. Because the gas contained within the fuel tank T includes fuel vapor, it is hard to effectively desorb the fuel vapor from the adsorption material by using the gas for purging.

In order to solve this problem, it may be possible to open the atmospheric-side opening and closing valve 105 for introducing external air into the canister 103. However, if external air flows into the canister 103, the external air may be drawn into the fuel tank T via the recovery passage 108 to cause another problem of increase in the internal pressure of the fuel tank T.

Therefore, there is a need in the art for a fuel vapor processing apparatus that can inhibit increase in an internal pressure of a fuel tank without accompanying decrease in the recovering efficice of fuel vapor.

SUMMARY OF THE INVENTION

A fuel vapor processing apparatus includes a device that can restrict or prevent flow of gas from a vapor passage into a canister during recovering of fuel vapor from the canister into a fuel tank.

DETAILED DESCRIPTION OF THE INVENTION

Figure 1:
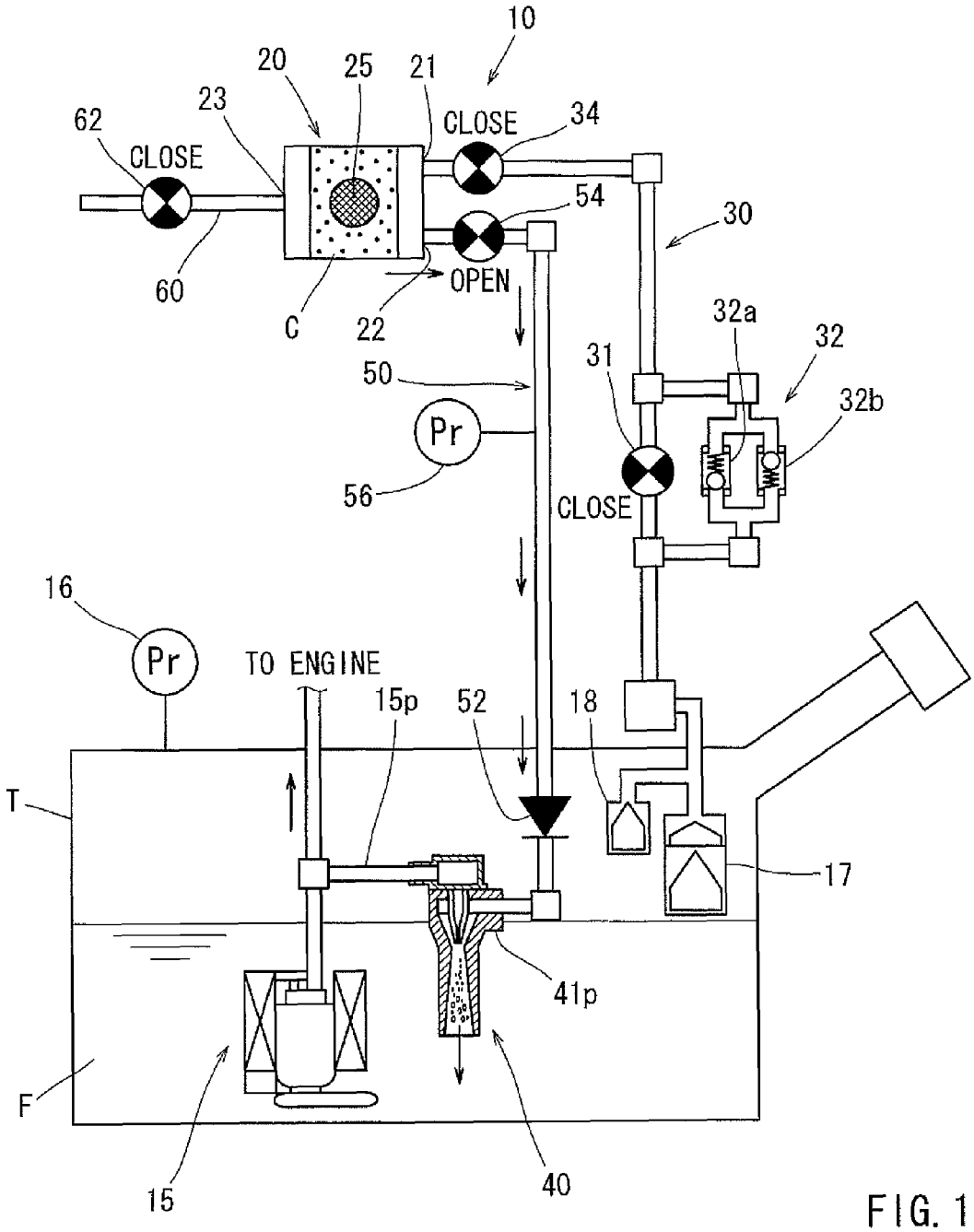
FIG. 1 is a schematic view of a fuel vapor processing apparatus according to an example.

Each of the additional features and teachings disclosed above and below may be utilized separately or in conjunction with other features and teachings to provide improved fuel vapor processing apparatus. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one example, a fuel vapor processing apparatus includes a vapor passage capable of introducing fuel vapor, which is produced within a fuel tank of an automobile, into a canister. The apparatus further includes an atmospheric-side opening and closing device provided at the canister, a negative pressure generating device capable of generating a negative pressure, and a recovery passage communicating between the negative pressure generating device and the canister, so that fuel vapor stored within the canister can be recovered into the fuel tank through the recovery passage by the operation of the negative pressure generating device. The apparatus further includes a vapor passage opening and closing device capable of opening and closing the vapor passage. During recovering of fuel vapor within the canister into the fuel tank by the operation of the negative pressure generating device, on the condition that the atmospheric-side opening and closing mechanism operates to close, flow of gas from the vapor passage into the canister is restricted by the vapor passage opening and closing device.

Therefore, during the recovery process, fuel vapor within the fuel tank is hard to flow into the canister, so that it is possible to inhibit reduction of fuel vapor recovering efficiency. In addition, because fuel vapor is recovered into the fuel tank on the condition that the internal pressure of the canister is negative while the atmospheric-side opening and closing device operates to close. Therefore, external air may not flow into the fuel tank, and hence, it is possible to inhibit increase of the internal pressure of the fuel tank.

The vapor passage opening and closing device may include a device capable of releasing gas within the fuel tank toward the canister when an internal pressure of the fuel tank has increased to be equal to or more than a predetermined value.

Therefore, for example, in the case that the amount of production of fuel vapor has increased due to increase of temperature, etc., so as to cause increase of the internal pressure of the fuel tank, it is possible to inhibit such increase of the internal pressure by the vapor passage opening and closing device.

The fuel vapor processing apparatus may further include a sub-tank associated with the fuel tank and capable of inhibiting increase of the internal pressure of the fuel tank. Therefore, it is possible to inhibit increase of the internal pressure of the fuel tank by the sub-tank.

The fuel vapor processing apparatus may further include a heater provided at the canister and capable of heating an adsorption material that is contained in the canister for adsorbing fuel vapor. Heating the adsorption material by the heater enables fuel vapor adsorbed by the adsorption material to be easily desorbed from the adsorption material, so that it is possible to improve the fuel vapor recovering efficiency.

The negative pressure generating device may generate a negative pressure by utilizing a flow of fuel discharged from a fuel pump disposed within the fuel tank. Alternatively, the negative pressure generating device may be a negative pressure pump.

EXAMPLES

An example will now be described with reference to FIGS. 1 to 6. A fuel vapor processing apparatus of this example can prevent or inhibit fuel vapor, which may be produced within a fuel tank T of an automobile, from being leaked into the atmosphere. This apparatus is also configured to be able to recover the fuel vapor in to the fuel tank T.

(General Construction of Fuel Vapor Processing Apparatus)

Referring to FIG. 1, a fuel vapor processing apparatus 10 generally includes a canister 20 capable of adsorbing and desorbing fuel vapor, a vapor passage 30 for introducing fuel vapor produced within the fuel tank T into the canister 20, an aspirator 40 disposed within the fuel tank T for generating a negative pressure, a recovery passage 50 communicating between the aspirator 40 and the canister 20, and an atmospheric passage 60 capable of opening the canister 20 into the atmosphere.

The fuel tank T is configured as a substantially hermetically sealed tank and serves to store fuel F to be supplied to an engine of an automobile. A fuel pump 15 is disposed within the fuel tank T for feeding the fuel F into the engine under pressure. More specifically, the fuel pump 15 is configured such that a part of the fuel F discharged from the fuel pump 15 can be supplied to the aspirator 40. As will be explained later, the aspirator 40 can generate a negative pressure by using the flow of the fuel F supplied from the fuel pump 15.

A first pressure sensor 16 is mounted to the fuel tank T for detecting the internal pressure of the fuel tank T and outputting a pressure detection signal to an ECU (engine control unit) (not shown).

(Canister)

The canister 20 is configured as a substantially hermetically sealed container. An adsorption material C made of activator carbon or any other suitable material is filled into the canister 20. The canister 20 includes a vapor port 21 connected to the vapor passage 30, a recovery port 22 connected to the recovery passage 50, and an atmospheric port 23 connected to the atmospheric passage 60. Therefore, the adsorption material C can adsorb fuel vapor, when the fuel vapor is introduced from the vapor passage 30 into the canister 20 via the vapor port 21. When the aspirator 40 is operated to apply a negative pressure to the canister 30 via the recovery passage 50 and the recovery port 22, fuel vapor adsorbed by the adsorption material C may be desorbed from the adsorption material C. Further, a heater 25 is disposed within the canister 20 and can heat the adsorption material C during desorption of the fuel vapor from the adsorption material C. Typically, the adsorption material C that is made of activated carbon or the like has such a characteristic that the fuel vapor can be more easily desorbed from the adsorption material C as the negative pressure increases or as the temperature increases.

An atmospheric-side solenoid valve 62 is provided at the atmospheric passage 60 of the canister 20. The atmospheric-side solenoid valve 62 can close when energized (ON turning), and it can open when non-energized (OFF turning). The atmospheric-side solenoid valve 62 operates according to an operation signal supplied from the ECU. More specifically, the atmospheric-side solenoid valve 62 is opened during filling of fuel into the fuel tank T and when the internal pressure of the fuel tank T becomes equal to or more than a maximum limit value ("DETERMINED VALUE B" in FIG. 2(B)).

(Vapor Passage)

As described previously, the vapor passage 30 serves to introduce the fuel vapor produced within the fuel tank T into the canister 20. A fill-up restriction valve 17 and a cut-off valve 18 are connected to the fuel tank-side end portion of the vapor passage 30. The fill-up restriction valve 17 opens when the level of the fuel F within the fuel tank T is equal to or lower than a fill-up level, while it closes when the fuel level exceeds the fill-up level. To this end, the fill-up restriction valve 17 has a float valve member floating on the fuel surface and moving upward to close its flow passage when the fuel level exceeds the fill-up level. The cut-off valve 18 is positioned at a higher level than the fill-up restriction valve 17 and normally opens. For example, when the automobile has been overturned by a traffic accident or the like, the cut-off valve 18 can operate to close.

A first solenoid valve 31 and a bi-directional check valve 32 are provided in the midway of the vapor passage 30 and are arranged in parallel to each other. The first solenoid valve 31 can open when it is energized (ON turning), while it can close when it is not energized (OFF turning). The first solenoid valve 31 operates according to a control signal supplied from the ECU. More specifically, the first solenoid valve 31 is normally closed and can open during filling of the fuel into the fuel tank T.

The bi-directional check valve 32 includes a positive pressure valve 32*a* and a negative pressure valve 32*b*. The positive pressure valve 32*a* opens when the internal pressure of the fuel tank T is equal to or more than a predetermined value (e.g., about +5 kPa). The negative pressure valve 32*b* opens when the internal pressure of the fuel tank T is equal to or less than a predetermined value (e.g., about −5 kPa). Therefore, for example, if the relationship "+5 kPa>P>−5 kPa" is resulted, both of the positive and negative pressure valves 32*a* and 32*b* are closed. Here, "P" designates the internal pressure of the fuel tank.

A second solenoid valve 34 is provided at the canister-side end portion of the vapor passage 30. The second solenoid valve 34 can close when it is energized, while it can open when it is not energized. The first solenoid valve 34 operates according to a control signal supplied from the ECU. More specifically, the second solenoid valve 34 opens when the internal pressure P of the fuel tank T becomes equal to or more than a predetermined value (e.g., +5 kPa) or during collection of the fuel vapor.

In this way, the first solenoid valve 31, the bi-directional check valve 32 and the second solenoid valve 34 constitute a vapor passage opening and closing device.

(Aspirator)

Figure 2A:
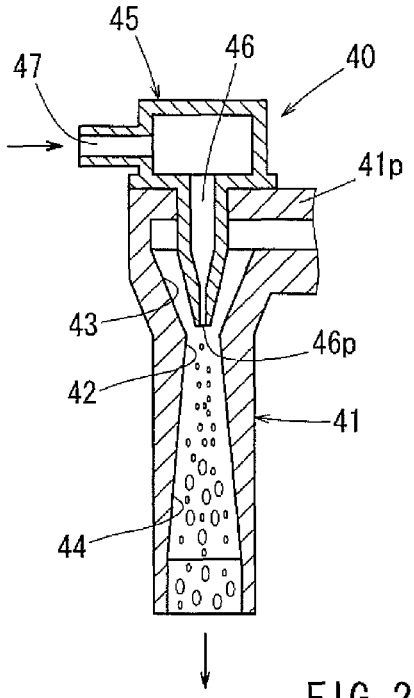
FIG. 2(A) is a vertical sectional view of an aspirator of the fuel vapor processing apparatus.
Figure 2B:
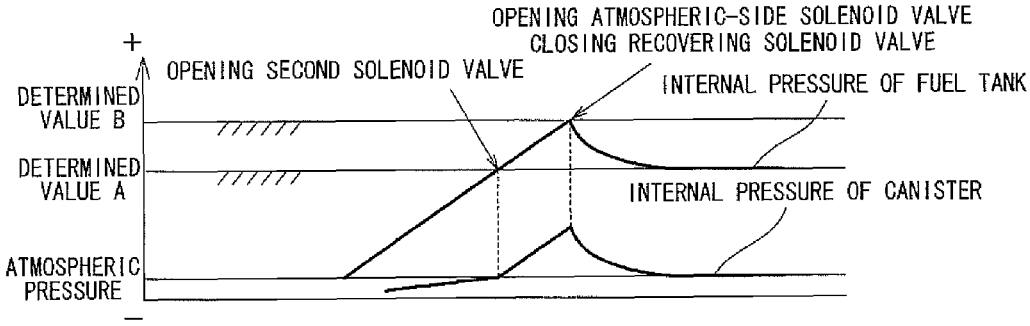
FIG. 2(B) is a graph showing illustrating operations of solenoid valves of the fuel vapor processing apparatus when an internal pressure of a fuel tank increases.

The aspirator 40 is constructed to generate a negative pressure by utilizing the flow of the fuel F supplied from the fuel pump 15. As shown in FIG. 2 (A), the aspirator 40 is constituted by a venturi part 41 and a nozzle part 45. The venturi part 41 defines therein a throttle portion 42, an inlet-side diameter decreasing portion 43 positioned on the upstream side of the throttle portion 42, and an outlet-side diameter increasing portion 44 positioned on the downstream side of the throttle portion 42. In this example, the inlet-side diameter decreasing portion 43, the throttle portion 42 and the outlet-side diameter increasing portion 44 are formed coaxially with each other. A suction port 41*p* for connection with the recovery passage 50 is formed with the upstream-side end of the inlet-side diameter decreasing portion 43 of the venturi part 41.

The nozzle part 45 includes a nozzle body 46 coaxially received within the inlet-side diameter decreasing portion 43 of the venturi part 41. The nozzle body 46 has a jet orifice 46*p* positioned proximal to the throttle portion 42 of the venturi part 41. In addition, a fuel supply port 47 for connection with a branch pipe 15*p* of the fuel pump 15 (see FIG. 1) is formed at the base end (on the side opposite to the jet orifice 46*p*) of the nozzle body 46.

With the above construction, the fuel F supplied from the fuel pump 15 to the aspirator 40 is injected from the jet orifice 46*p* of the nozzle body 46 and flows at a high speed through the throttle portion 42 and the central portion of the outlet-side diameter increasing portion 44 in the axial direction of the venturi part 41. Therefore, the pressure of the region around the throttle portion 42 of the venturi part 41 becomes negative, so that fluid (i.e. the fuel vapor and air) contained within the inlet-side diameter decreasing portion 43 flows toward the downstream side along with the fuel F injected from the nozzle body 46. Hence, fluid (i.e., fuel vapor and other) contained within the recovery passage 50 connected to the suction port 41*p* of the venturi part 41 may be drawn into the venturi part 41. In this way, the aspirator 40 serves as a negative pressure generating device.

(Recovery Passage)

The recovery passage 50 connects between the recovery port 22 of the canister 20 and the suction port 41*p* of the aspirator 40. A unidirectional check valve 52 is provided at the fuel tank-side end portion of the recovery passage 50. The unidirectional check valve 52 permits flow of fluid from the canister 20 toward the aspirator 40 but prevents flow of fluid from the aspirator 40 toward the canister 20.

A solenoid valve 54 for recovering the fuel vapor (herein after called "recovery solenoid valve 54") is provided at the canister side end portion of the recovery passage 50. The recovery solenoid valve 54 can open when it is energized, while it can close when it is not energized. The recovery solenoid valve 54 operates according to a control signal supplied from the ECU. More specifically, the recovery solenoid valve 54 opens during recovering of the fuel vapor.

A second pressure sensor 56 is mounted to the recovery passage 50 at a position between the recovery solenoid valve 54 and the unidirectional check valve 52. The second pressure sensor 56 outputs its detection signal to the ECU.

(Operation of Fuel Vapor Processing Apparatus)

Figure 3:
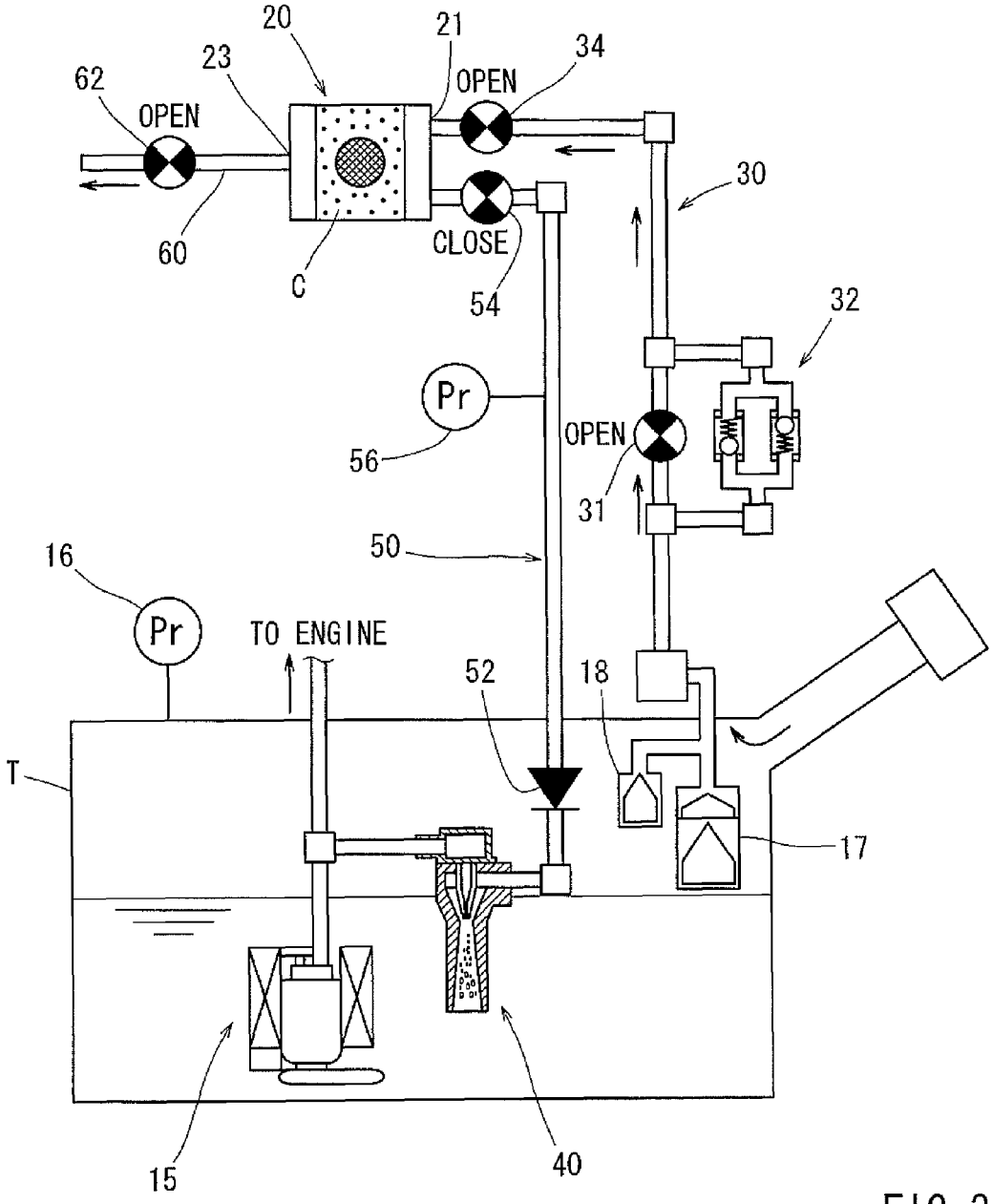
FIGS. 3 and 4 are schematic views showing operations of the fuel vapor processing apparatus.

During filling of the fuel into the fuel tank T, the first solenoid valve 31 and the second solenoid valve 34 of the vapor passage 30 and the atmospheric side solenoid valve 62 of the atmospheric passage 60 are opened as shown in FIG. 3. On the other hand, the recovery solenoid valve 54 of the recovery passage 50 is closed. Therefore, during filling of the fuel, gas (air and fuel vapor) within the fuel tank T is urged to flow into the vapor passage 30 via the fill-up restriction valve 17 and the cut-off valve 18 and further into the canister 20 by flowing through the first and second solenoid valves 31 and 34 of the vapor passage 30 (see arrows in FIG. 3). Then, the fuel vapor is adsorbed by the adsorption material C of the canister 20, while air remaining due to removal of the fuel vapor is discharged from the canister 30 to the atmosphere via the atmospheric-side solenoid valve 62 of the atmospheric passage 60.

As a result, during filling of the fuel, the internal space of the fuel tank T is opened to the atmosphere via the vapor passage 30, the canister 20 and the atmospheric passage 60. Therefore, it is possible to reduce resistance against flow of gas within the fuel tank when such gas flows through the vapor passage 30 and the other passages.

Figure 4:
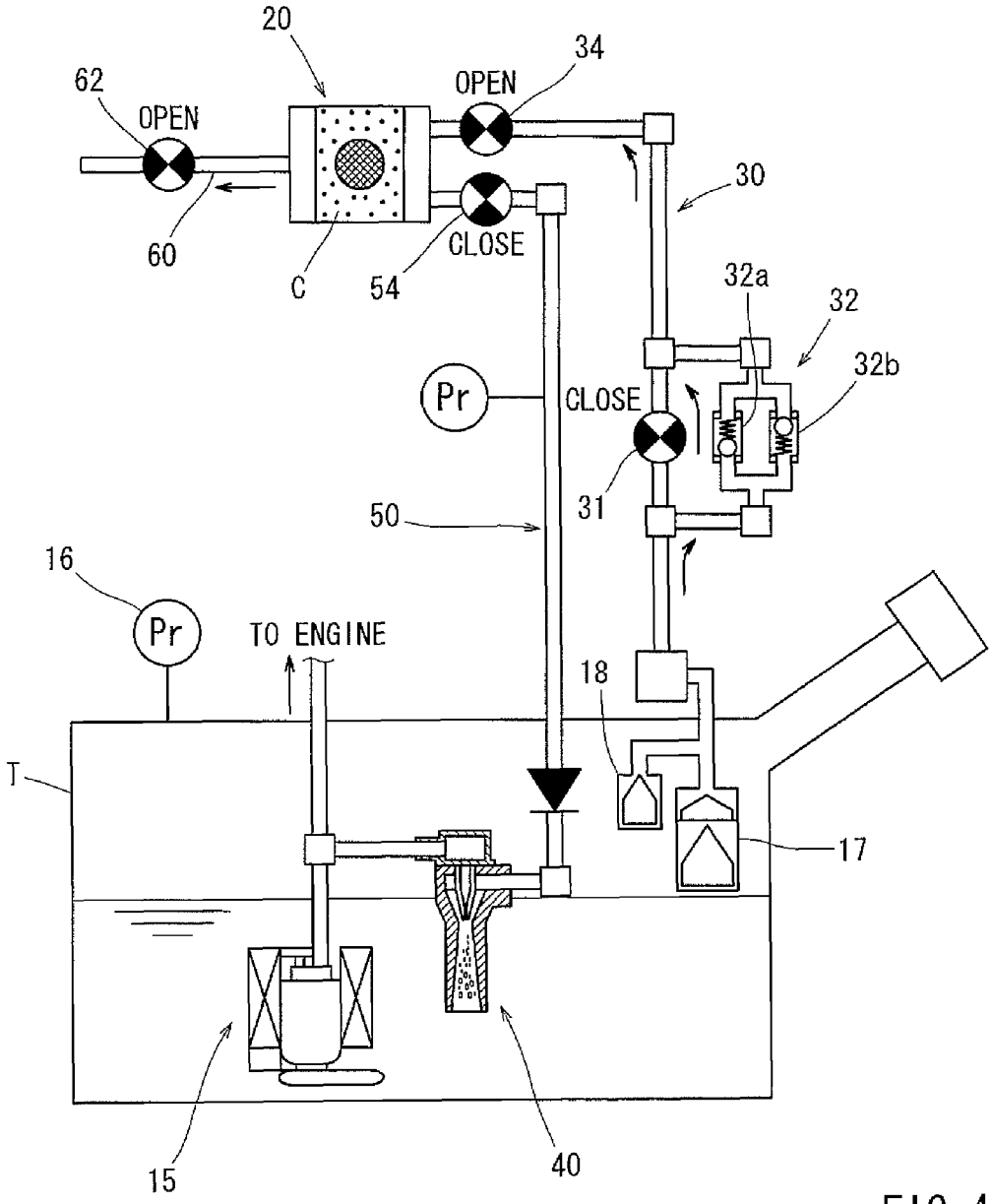

During collection of the fuel vapor, the fist solenoid valve 31 of the vapor passage 30 is closed, while the second solenoid valve 34 of the vapor passage 30 and the atmospheric side solenoid valve 62 of the atmospheric passage 60 are opened as shown in FIG. 4. On the other hand, the recovery solenoid valve 54 of the recovery passage 50 is closed. Therefore, air and fuel vapor within the fuel tank T can flow through the vapor passage 30 as indicated by arrows in FIG. 4 when the internal pressure of the fuel tank T is equal to or more than the predetermined pressure (e.g., +5 kPa) set for the positive pressure valve 32*a* of the bi-directional check valve 32. Hence, air and fuel vapor within the fuel tank T flows into the vapor passage 30 via the fill-up restriction valve 17, etc., and further flows into the canister 20 after flowing through the positive pressure valve 32*a* of the bi-directional check valve 32 and the second solenoid valve 34. Then, the fuel vapor is adsorbed by the adsorption material C within the canister 20, and air remaining after removal of the fuel vapor is discharged from the canister 20 to the atmosphere via the atmospheric-side solenoid valve 62 of the atmospheric passage 60. In this way, when the internal pressure of the fuel tank T is increased to be equal to or more than the predetermined pressure (e.g., +5 kPa), the internal pressure of the fuel tank T is released to the outside, so that the fuel tank T can be protected from being damaged by the increase of the internal pressure.

If the relationship "+5 kPa>P>−5 kPa" is resulted for the internal pressure P of the fuel tank T, both of the positive and negative pressure valves 32*a* and 32*b* are closed, and therefore, the fuel tank T can be kept to be sealed from the outside. Therefore, fuel vapor produced within the fuel tank T may not leak to the outside.

When the internal pressure P of the fuel tank becomes equal to or lower than −5 kPa, for example, due to decrease of temperature, the negative pressure valve 32*b* of the bi-directional check valve 32 is opened, so that external air may enter the fuel tank T via the atmospheric port 60, the canister 20 and the vapor passage 30. As a result, pressure drop within the fuel tank T can be inhibited, and therefore, the fuel tank T can be protected.

During recovering of the fuel vapor, the fist solenoid valve 31 and the second solenoid valve 34 of the vapor passage 30 and the atmospheric side solenoid valve 62 of the atmospheric passage 60 are closed as shown in FIG. 1. On the other hand, the recovering solenoid valve 54 of the recovery passage 54 is opened. In addition, electric power is supplied to the heater 25 within the canister 20, so that the heater 25 heats the adsorption material C within the canister 20. Therefore, fuel vapor can be easily desorbed from the adsorption material C.

Further, the fuel pump 15 is driven, so that a part of the fuel F discharged from the fuel pump 15 is supplied to the aspirator 40. Therefore, the aspirator 40 is operated to cause fuel vapor and air, etc., stored within the canister 20 to be drawn into the aspirator 40 via the recovery passage 50, the recovery solenoid valve 54 and the unidirectional check valve 52. Thus, the interior of the canister 20 is held under a negative pressure condition, and fuel vapor, etc., stored within the canister 20 is drawn into the aspirator 40 and is thereafter discharged into the fuel F within the fuel tank T so as to be recovered.

In this way, during recovering of the fuel vapor, the fist solenoid valve 31 and the second solenoid valve 34 of the vapor passage 30 and the atmospheric side solenoid valve 62 of the atmospheric passage 60 are closed, and therefore, no external air can enter the fuel tank T via the canister 20 and the recovery passage 50 when the aspirator 40 is operated. As a result, it is possible to prevent the internal pressure of the fuel tank T from increasing.

If the internal pressure of the fuel tank T has increased to reach the predetermined value ("DETERMINED VALUE A"), e.g., +5 kPa, during the recovering process, for example, due to increase of the temperature of the fuel tank T, the second solenoid valve 34 is opened. Then, the gas within the fuel tank T may be relieved into the canister 20 via the positive pressure valve 32*a* of the bi-directional check valve 32 of the vapor passage 30 and the second solenoid valve 34. Therefore, increase of the internal pressure of the fuel tank T can be inhibited.

On the condition that the second solenoid valve 34 is opened, if the internal pressure of the fuel tank T has increased further to reach the maximum limit value ("DETERMINED VALUE B"), the atmospheric-side solenoid valve 62 of the atmospheric passage 60 is opened and the recovery solenoid valve 54 is closed to release the pressure within the canister 20 to the atmosphere. Here, the fuel vapor is collected by the adsorption material C of the canister 20, so that only air is discharged from the canister 20 to the atmosphere. As a result, the internal pressure of the fuel tank T can be lowered by discharging air within the canister system to the atmosphere.

In this way, the first solenoid valve 31, the second solenoid valve 34 and the bi-directional check valve 32 serve as a vapor passage opening and closing device. The atmospheric-side solenoid valve 62 serves as an atmospheric side opening and closing device.

(Advantages of Fuel Vapor Processing Apparatus)

According to the fuel vapor processing apparatus 10 of the above example, during recovering of the fuel vapor contained within the canister 20 into the fuel tank T by the operation of the aspirator 40, flow of gas from the vapor passage 30 into the canister 20 is restricted, while the atmospheric-side solenoid valve 62 being closed. Thus, during the recovery of the fuel vapor, the fuel vapor within the fuel tank T is inhibited from entering the canister 20. Therefore, it is possible to inhibit decrease of the fuel vapor recovering efficiency.

Further, the fuel vapor is recovered into the fuel tank T on that condition that the atmospheric-side solenoid valve 62 is closed and the internal pressure of the canister 20 is brought to be negative. Therefore, external air may not flow into the fuel tank T, so that it is possible to prevent increase of the internal pressure of the fuel tank T.

The second solenoid valve 34 and the bi-directional check valve 32 of the vapor passage 30 can release the internal pressure of the fuel tank T toward the canister 20 when the internal pressure of the fuel tank T becomes equal to or more than the predetermined value (+5 kPa). Therefore, it is possible to inhibit increase of the internal pressure of the fuel tank T in the case that the internal pressure has increased, for example, due to increase of amount of generation of vapor, which may accompany with increase in temperature.

Further, because the heater 25 is disposed in the canister 20 for heating the adsorption material C, fuel vapor adsorbed by the adsorption material C can be easily desorbed from the adsorption material C, so that the fuel vapor recovering efficiency can be improved.

Furthermore, the atmospheric-side solenoid valve 62 allows the canister 20 to be opened to the atmosphere when the pressure within the fuel tank T reaches the maximum limit value exceeding the predetermined value. Therefore, it is possible to effectively lower the pressure within the fuel tank T by releasing the pressure through the canister 20 and the recovery passage 50, etc.

<Possible Modifications>

Figure 5:
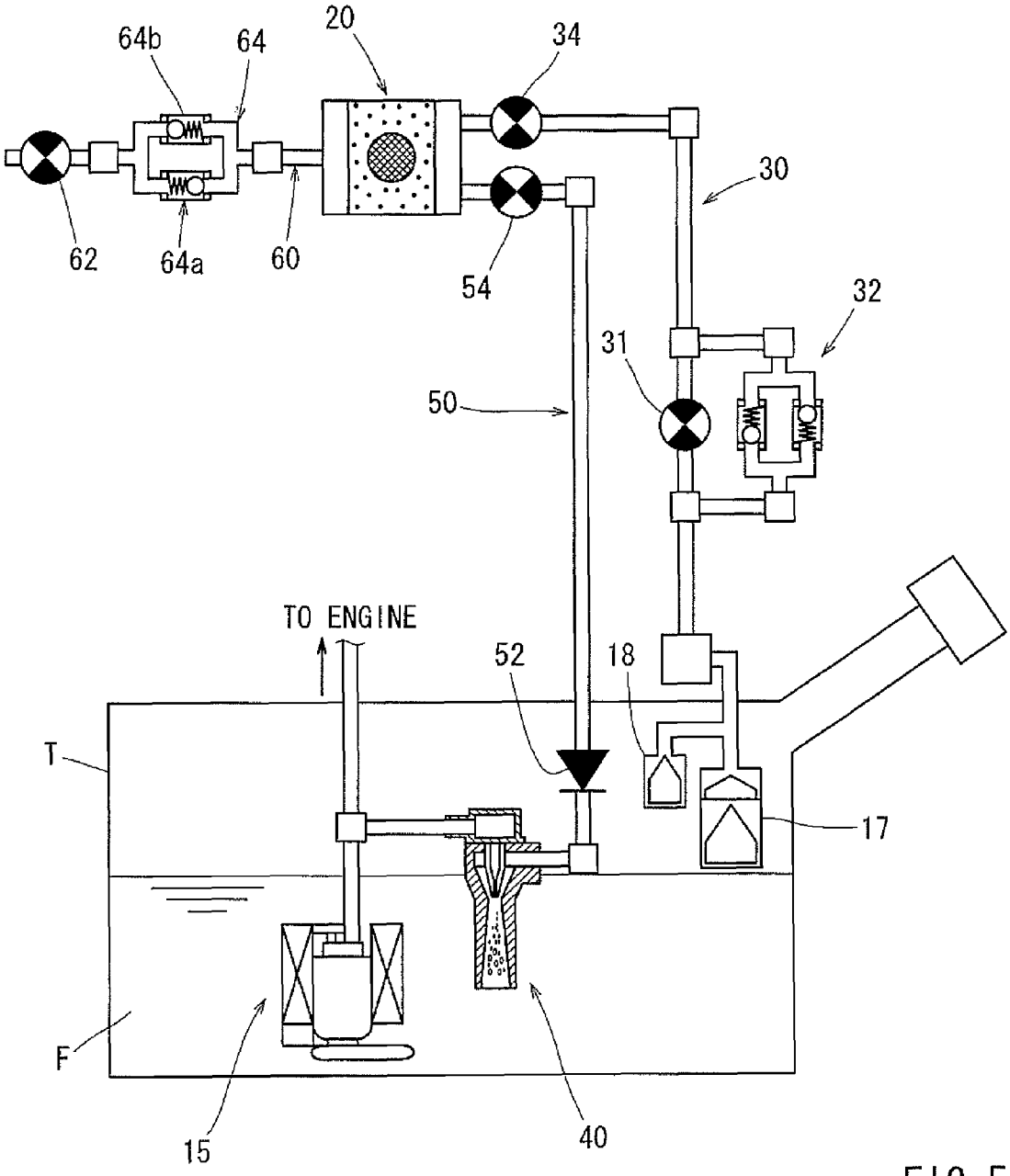
FIG. 5 is a schematic view showing the operation of a fuel vapor processing apparatus according to another example.

The above example can be modified in various ways. For example, in the above example, only the atmospheric-side solenoid valve 62 is provided in the atmospheric passage 60 of the canister 20. However, as shown in FIG. 5, it is possible to provide a bi-directional check valve 64 between the canister 20 and the atmospheric-side solenoid valve 62 for maintaining a negative pressure within the canister 20. For example, a positive pressure valve 64*a* of the bi-directional check valve 64 may open when the internal pressure of the canister 20 is equal to or more than a predetermined value (e.g., +0.03 kPa). A negative pressure valve 64*b* of the bi-directional check valve 64 may open when the internal pressure of the canister 20 is equal to or less than a predetermined value (e.g., −5 kPa). Therefore, if the relationship "−5 kPa<Pk<+0.03 kPa" is resulted, for example, in the case that the pressure within the canister 20 has become negative due to drop of the fuel level by the consumption of the fuel F, the positive and negative pressure valves 32*a* and 32*b* are closed, so that the negative pressure of the canister 20 can be maintained. Here, "Pk" designates the internal pressure of the canister 20. Therefore, in the case that gas (fuel vapor, air, etc.) within the canister 20 is drawn by the aspirator 40 during the recovery process, increase of the internal pressure within the fuel tank T can be further reliably inhibited, because the interior of the canister 20 already has a negative pressure.

Figure 6:
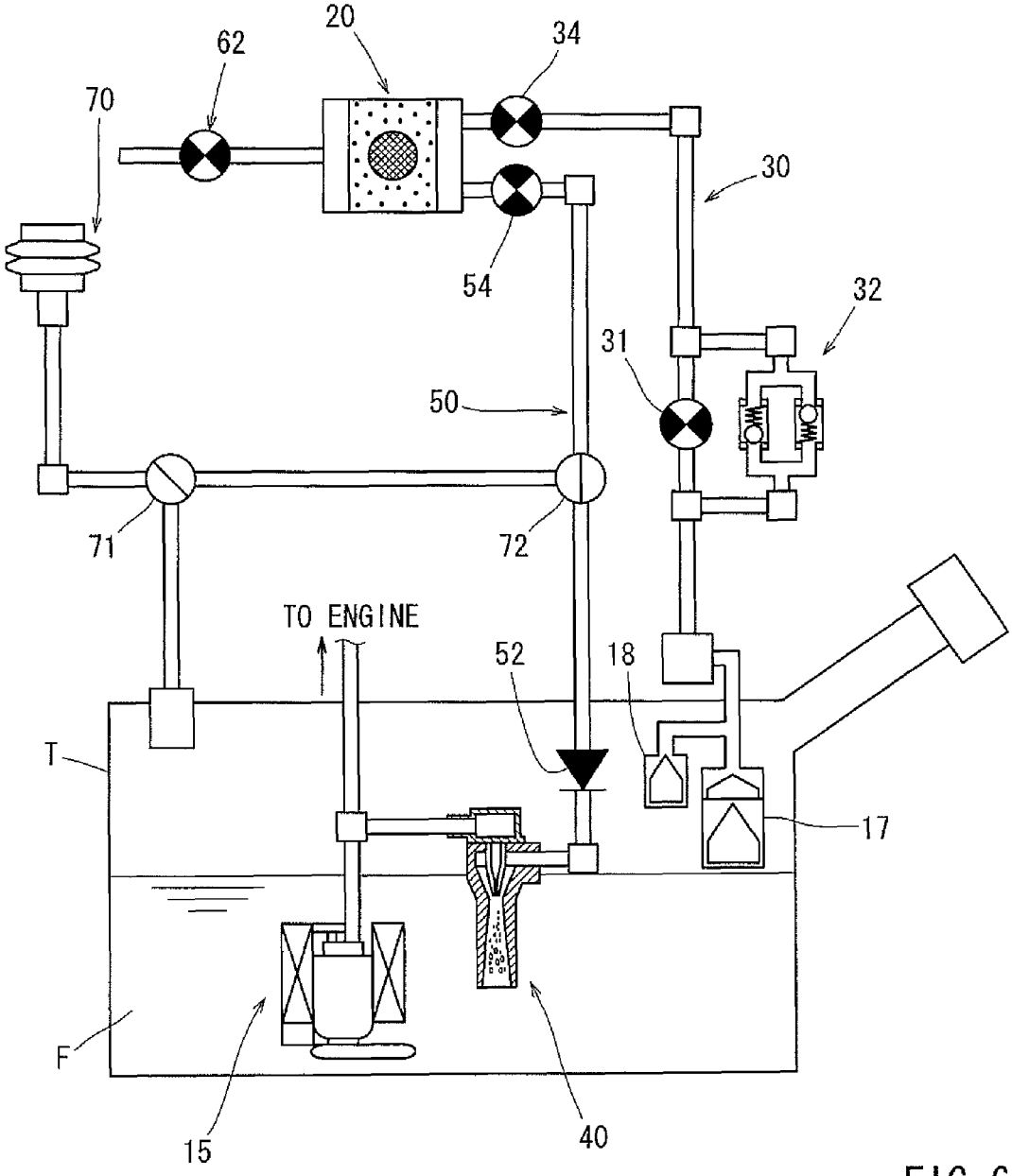
FIG. 6 is a schematic view showing the operation of a fuel vapor processing apparatus according to a further example.

Furthermore, in the above example, the second solenoid valve 34 and the atmospheric-side solenoid valve 62 are opened to inhibit increase of the internal pressure of the fuel tank T during the recovery process. However, as shown in FIG. 6, it may be possible to provide an expandable sub-tank 70 that can communicate with the fuel tank T via three-way valves 71 and 72, so that the internal pressure within the fuel tank T can be released into the sub-tank 70 when the internal pressure has increased. The expanded sub-tank 70 can be constricted by the negative pressure produced by the aspirator 40 by switching the three-way valves 71 and 72, so that it is possible to control the internal pressure of the sub-tank 70.

Furthermore, the bi-directional check valves 32 and 64 can be replaced with solenoid valves by replacing the positive pressure valves 32*a* and 64*a* and the negative pressure valves 32*b* and 64*b* with solenoid valves that may operate according to the internal pressure of the fuel tank T and the internal pressure of the canister 20.

Figure 7:
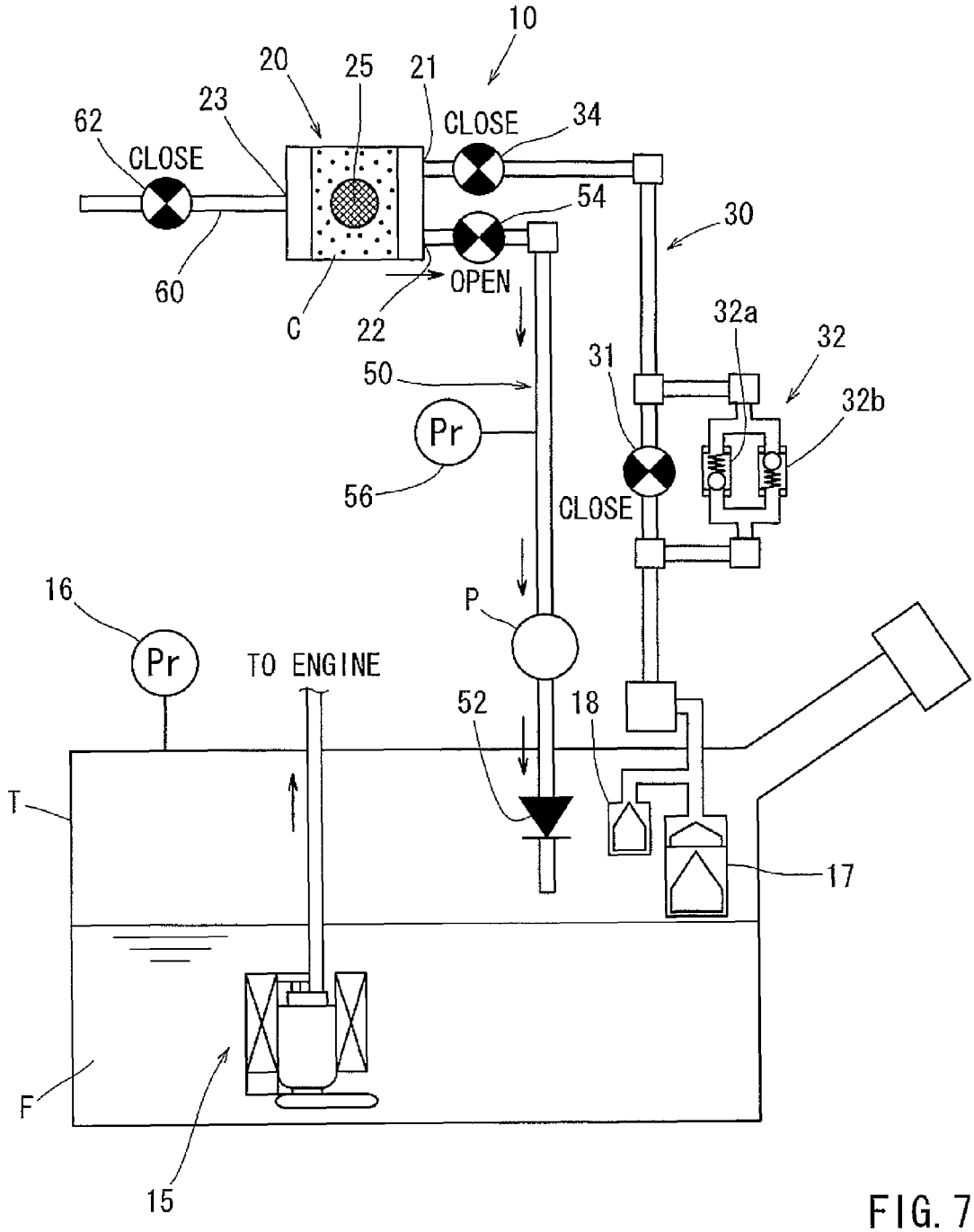
FIG. 7 is a schematic view of a fuel vapor processing apparatus according to a further example.
Figure 8:
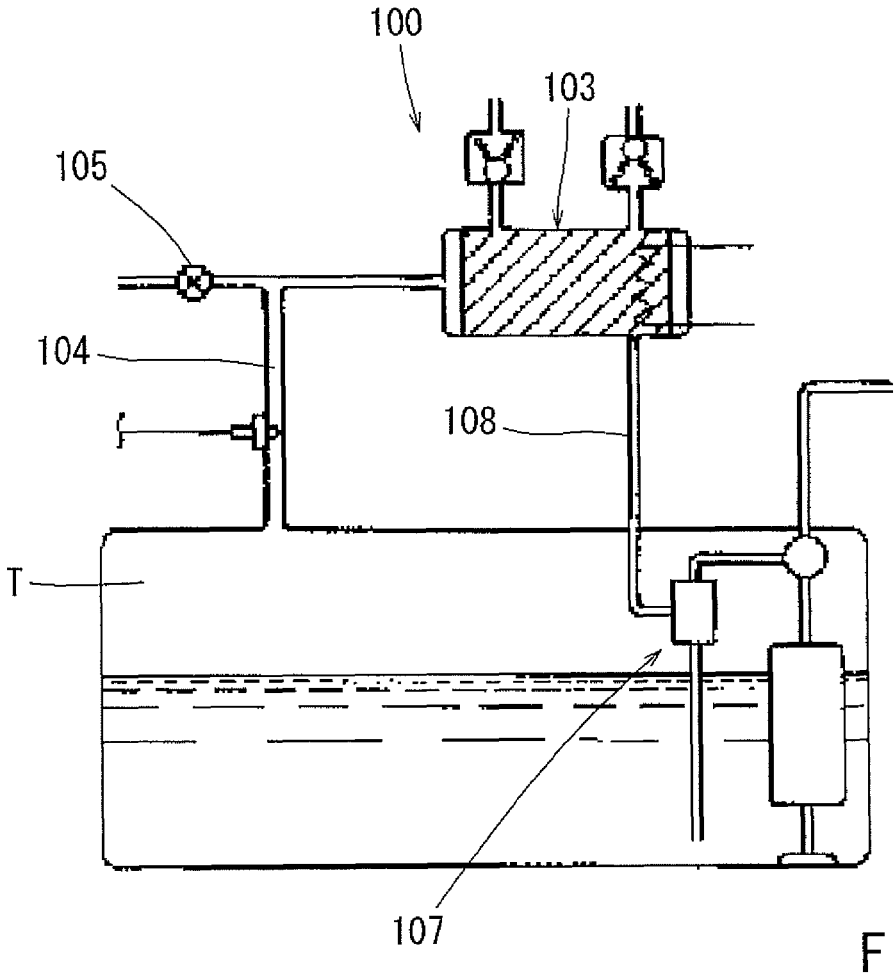
FIG. 8 PRIOR ART
FIG. 8 is a schematic view of a known fuel vapor processing apparatus.

Furthermore, the aspirator 40 can be replaced with a negative pressure pump or a vacuum pump P that is provided in the recovery passage 50 as shown in FIG. 7.

Furthermore, the fuel supply port 47 of the aspirator 40 may directly receive the supply of the pressurized fuel from the fuel pump 15 or a fuel pump unit. It is also possible that the fuel supply port 47 receive the supply of the pressurized fuel diverged from a return pipe of a fuel pressure regulator (not shown).

This invention claims:

1. A fuel vapor processing apparatus comprising:

a vapor passage capable of introducing fuel vapor into a canister, the fuel vapor being produced within a fuel tank of an automobile:

an atmospheric-side opening and closing device provided at the canister;

a negative pressure generating device capable of generating a negative pressure;

a recovery passage communicating between the negative pressure generating device and the canister, so that fuel vapor stored within the canister can be recovered into the fuel tank through the recovery passage by the operation of the negative pressure generating device; and a vapor passage opening and closing device capable of opening and closing the vapor passage;

wherein during recovering of fuel vapor within the canister into the fuel tank by the operation of the negative pressure generating device, when the pressure within the fuel tank is lower than a first predetermined pressure, the atmospheric-side opening and closing mechanism and the vapor passage opening and closing device are closed, and when the pressure within the fuel tank is equal to or higher than the first predetermined pressure, the vapor passage opening and closing device can be opened for releasing gas within the fuel tank toward the canister while the atmospheric-side opening and closing mechanism is closed.

2. The fuel vapor processing apparatus as in claim 1, further comprising a sub-tank associated with the fuel tank and capable of inhibiting increase of the internal pressure of the fuel tank.

3. The fuel vapor processing apparatus as in claim 1, further comprising a heater provided at the canister and capable of heating an adsorption material that is contained in the canister for adsorbing fuel vapor.

4. The fuel vapor processing apparatus as in claim 1, wherein the negative pressure generating device generates a negative pressure by utilizing a flow of fuel discharged from a fuel pump disposed within the fuel tank.

5. The fuel vapor processing apparatus as in claim 1, wherein the negative pressure generating device comprises a negative pressure pump.

6. The fuel vapor processing apparatus as in claim 1, wherein;

during recovery of fuel vapor within the canister into the fuel tank, when the pressure within the fuel tank is equal to or higher than the first predetermined pressure and is less than a second predetermined pressure, the atmospheric-side opening and closing mechanism is closed and the vapor passage opening and closing device is opened; and when the pressure within the fuel tank is equal to or higher than the second predetermined pressure, the atmospheric-side opening and closing mechanism is opened and the vapor passage opening and closing device is opened, so that the pressure within the fuel tank and the pressure within the canister is released to the atmosphere.

7. A fuel vapor processing apparatus comprising:

a canister having therein an adsorption material capable of adsorbing fuel vapor produced within a fuel tank of an automobile;

wherein the canister has a first side and a second side opposite to the first side with respect to the adsorption material;

a fuel vapor introducing passage and a fuel vapor recovering passage each communicating between the fuel tank and the first side of the canister, so that fuel vapor produced within the fuel tank can be introduced into the canister via the fuel vapor introducing passage and fuel vapor contained within the canister can be recovered into the fuel tank via the fuel vapor recovering passage;

a pump device disposed in the fuel vapor recovering passage and capable of producing a flow of fuel vapor from the canister into the fuel tank;

an atmospheric passage communicating between the second side of the canister and an atmosphere;

a first valve disposed in the fuel vapor introducing passage and capable of opening and closing the fuel vapor introducing passage; and a second valve disposed in the atmospheric passage and capable of opening and closing the atmospheric passage;

wherein during recovery of fuel vapor within the canister into the fuel tank, each of the first valve and the second valve operates to be opened and closed in response to the pressure within the fuel tank.

8. The fuel vapor processing apparatus as in claim 7, wherein the atmospheric passage is provided independently of the fuel vapor introducing passage and the fuel vapor recovering passage.

9. The fuel vapor processing apparatus as in claim 7, further comprising a third valve disposed in the fuel vapor recovering passage on an upstream side of the pump device and capable of opening and closing the fuel vapor recovering passage.

10. The fuel vapor processing apparatus as in claim 7, wherein the pump device is driven by a flow of fuel supplied from a fuel pump that is disposed within the fuel tank for feeding the fuel to an automobile engine.

11. The fuel vapor processing apparatus as in claim 9, further comprising a check valve disposed within the fuel vapor recovering passage between the third valve and the pump device.

12. The fuel vapor processing apparatus as in claim 7, further comprising a check valve disposed in the fuel vapor introducing passage in parallel with the first valve.

13. The fuel vapor processing apparatus as in claim 12, wherein the check valve comprises a positive check valve and a negative check valve arranged in parallel with each other.

* * * * *